United States Patent [19]

Miller

[11] 4,024,308

[45] May 17, 1977

[54] DURABLY FLAME PROOFED TEXTILE MATERIALS

[75] Inventor: George T. Miller, Lewiston, N.Y.

[73] Assignee: Hooker Chemicals & Plastics Corporation, Niagara Falls, N.Y.

[22] Filed: Dec. 22, 1975

[21] Appl. No.: 642,888

Related U.S. Application Data

[63] Continuation-in-part of Ser. No. 527,105, Nov. 25, 1974, abandoned, which is a continuation of Ser. No. 307,327, Nov. 16, 1972, abandoned.

[52] U.S. Cl. ..... 428/290; 428/272; 428/365; 428/394; 428/395; 428/921

[51] Int. Cl.[2] ..... B32B 27/00; D02G 3/00

[58] Field of Search ..... 428/365, 290, 272, 262, 428/267, 921, 394, 289; 252/8.1; 260/47 EP, 47 EC

[56] References Cited

UNITED STATES PATENTS

| | | | |
|---|---|---|---|
| 3,595,970 | 7/1971 | Nolken | 260/831 X |
| 3,816,212 | 6/1974 | O'Brien | 428/921 X |
| 3,839,239 | 10/1974 | Godfried | 252/8.1 X |
| 3,841,902 | 10/1974 | Thompson et al. | 428/921 |

FOREIGN PATENTS OR APPLICATIONS

| | | |
|---|---|---|
| 1,035,912 | 7/1966 | United Kingdom |

*Primary Examiner*—Lorraine T. Kendell
*Attorney, Agent, or Firm*—Peter F. Casella; William J. Crossetta, Jr.; Arthur S. Cookfair

[57] ABSTRACT

Normally flammable fabrics, such as fabrics composed of polypropylene and polyamides such as polycaproamides, poly(m-phenyleneisophthalamides) and the like which have been rendered flame proof by the intimate association therewith of a flame proofing amount of a phosphoric acid are reacted in situ with an epoxy compound. The resultant compositions can be washed in water without substantial loss of flame proof character.

13 Claims, No Drawings

DURABLY FLAME PROOFED TEXTILE MATERIALS

This is a continuation-in-part of application Ser. No. 527,105 filed on Nov. 25, 1974, and now abandoned which is a continuation of application Ser. No. 307,327 filed Nov. 16, 1972, and now abandoned.

FIELD OF INVENTION

This invention relates to improvements in the flame proofing of normally flammable fabrics. More particularly it relates to the flame proofing of normally flammable fabrics composed of certain synthetic polymers and especially it relates to fabrics composed of poly(m-phenyleneisophthalamides) having an Oxygen Index of at least 40.

BACKGROUND OF THE INVENTION

Apparel for use in applications where under emergency conditions in a hazardous thermal environment might exist should satisfy the following minimum requirements.

a. The fabric from which the apparel is made should be resistant to burning, melting or disintegration on exposure to open flames or elevated temperatures.

b. The fabric should possess good dimensional stability on exposure to elevated thermal conditions since large thermal shrinkages tend to restrict mobility of the wearer.

c. The apparel should function as an effective thermal barrier in order to prevent severe skin burns, and d. The garments should be durable and comfortable to encourage their use.

It is known to treat normally flammable textile materials, of both natural and synthetic nature, with chemicals such as ammonium phosphate, tetrakis (hydroxymethyl) phosphonium oxides and polymers thereof, and the like to render them fire retardant. Such treatments while effective for rendering fabrics fire retardant under normal conditions of use, such as fabrics designed for use as curtains, rugs, sweaters and the like, are not satisfactory for use under emergency or highly hazardous conditions as in aviators flying suits or apparel designed for use in oxygen enriched atmospheres.

Synthetic materials, such as polybenzimidazoles and polyamides such as poly(m-phenyleneisophthalamides),polyhexamethyleneadipamides and polycaproamides which exhibit improved heat resistance compared to other synthetics such as polypropylene are known and these improved fibers have replaced the more conventional fire retardant materials in many special applications. In applicant's copending U.S. application Ser. No. 230,999 filed March 1, 1972, and now abandoned, it was disclosed that normally flammable fabrics such as fabrics composed of polypropylene and polyamides such as poly(m-phenylene isophthalamides) and the like could be rendered flame proof by the intimate association therewith of a flame proofing amount of a phosphoric acid. It was disclosed also, that although such a flame proofing treatment initially results in fabrics having an Oxygen Index of at least 40, this value was found to decrease on repeated washing of the treated fabric. It was disclosed in the aforementioned application, that the flame proofing treatment disclosed therein could be rendered fast to washing by applying to the treated material a coating of a synthetic resin-material, e.g., polyvinylidene chloride, perfluorinated organic polymers and the like, having an Oxygen Index of at least 40. Such coatings while generally effective on unfinished fabrics, e.g., yard goods and unwoven filaments, are difficult to apply efficiently to finished articles. The coating resin leaves unprotected the seams and other protected areas, such as the overlapping areas of the woven articles. Accordingly, a need still exists for a fiber with thermal characteristics superior to those of the aforementioned fibers and which is fast to washing in water.

OBJECTS OF THE INVENTION

It is, therefore, a principal object of this invention to devise improved wash fast flame proofed textile fabrics comprising normally flammable synthetic materials.

Another object is to provide a process for treating normally flammable synthetic materials to render them wash fast as well as flame proof.

A particular object is to devise compositions of normally flammable synthetic materials comprising an effective flame proofing amount of a phosphoric acid intimately associated therewith.

These and other objects of the present invention will be obvious from the following description.

BRIEF SUMMARY OF THE INVENTION

In accordance with the present invention there is provided flame proofed synthetic fibrous material which is fast to washing in water comprising a normally flammable synthetic material selected from the group consisting of polypropylene, poly(hexamethylene adipamide), polycaproamide, and poly(m-phenylene isophthalamide) which material contains a flame retardant amount of a phosphoric acid and which has been reacted, in-situ, with an epoxy resin.

These improved products are obtained by a process which comprises the steps of applying an epoxy resin to a normally flammable synthetic fibrous material of the above defined group which material has been rendered highly flame proof by intimately mixing the material with a flame proofing amount of a phosphoric acid and reacting said epoxy resin and said phosphoric acid, in situ.

The resultant flame proof character of the fabric is thereby rendered fast to washing in water.

By "effective flame proofing amount" is meant that amount of a phosphoric acid which suffices to increase the Oxygen Index of the treated material to 40 or above.

By the term "Oxygen Index" it is intended to define the percentage concentration of oxygen in a mixture of oxygen and nitrogen which will maintain equilibrium burning conditions, i.e., the heat produced during combustion just balances the heat lost to the surroundings. Physically, the Oxygen Index is the lowest concentration of oxygen, in an atmosphere of oxygen and nitrogen, which will support sustained combustion of the material and is calculated from the following equation $$\text{Oxygen Index} = \frac{100 \times O_2}{O_2 + N_2}$$

where $O_2$ is the oxygen concentration at equilibrium and $N_2$ is the associated nitrogen concentration. (See "The Oxygen Flame Flammability Test," J. L. Isaacs, J. Fire and Flammability, Vol. 1 (January 1970) page 36 et seq.)

In the practice of the present invention, the materials treated may be formed in whole or in part of the normally flammable synthetic polymer material and may be in various forms including yard or sheet goods, as well as various finished articles, such as articles of clothing including coats, shirts, trousers, skirts, jump suits, gloves, and the like, and such non textile articles as containers, bags, and the like. The materials may be woven, non woven, knitted, and the like. Accordingly although, hereinafter primary reference will be made to the treatment of fibrous woven synthetic polymer yard goods, this is not to be taken as a limitation as other forms of synthetic polymer materials, such as non-woven, films, foils, sheets, fibers and yarns, may, in many instances, be utilized as the materials treated in accordance with the present invention.

DETAILED DESCRIPTION OF THE INVENTION

In accordance with a preferred mode of carrying out the present invention normally flammable synthetic polymers, such as polypropylene, polycaproamides, polyhexamethylene adipamides and poly(m-phenylene isophthalamides) having intimately associated therewith an effective flame proofing amount of a phosphoric acid, and thus having been rendered flame proof in character are reacted in situ with an epoxy resin to fix the phosphoric acid in and on the synthetic polymer material.

It has been found as disclosed in the aforementioned Ser. No. 230,999, that normally flammable synthetic polymers which contain, intimately mixed therewith, at least about 0.4 percent by weight, and preferably from about 2 to about 25 percent by weight, of a phosphoric acid, preferably ortho phosphoric acid or pyrophosphoric acid, are rendered flame proof, that is the Oxygen Index of the treated synthetic polymer has been increased to about 40 or higher.

The flame proofing treatment can be accomplished by several means. For example the synthetic material, in the fibrous or woven condition, can be immersed, padded, sprayed, or dipped in or with an aqueous solution of a phosphoric acid and the thoroughly wetted material dried to remove excess moisture. The treated fabric may be heated to below the decomposition point of the synthetic polymer without significant effect on the treatment.

Alternatively the treatment can be effected by application of a solvent solution of elemental white phosphorus and thereafter the solvent evaporated under relatively mild conditions. Also, the polymer material may be exposed to vapors of phosphorus and thereby phosphorus is condensed on the surface of the material. The elemental phosphorus residue can then be oxidized on the fibrous material and hydrolyzed to pyrophosphoric acid in a known manner. "White phosphorus" as used herein includes various impure and commercial grades sometimes referred to as "yellow phosphorus".

The solvents used to assist in the application of the elemental white phosphorus to the polymer material should be one or a mixture of organic solvents which do not react with the material or the phosphorus, and should be readily removable from the treated material. Typical of such solvents are carbon disulfide, chloroform, perchloroethylene, trichloroethylene, benzene and the like. Trichloroethylene because of its non-reactive nature and ease of removal is the preferred solvent for the elemental white phosphorus.

The treatment can be carried out using cold or hot solutions of the phosphoric acid and with either dilute or concentrated solutions of the treatment acid. Conveniently 85 percent ortho phosphoric acid is used although higher or lower concentrations are useful also.

Any of the inorganic phosphoric acids can be used. Thus ortho, meta-, or pyrophosphoric acids and mixtures thereof are contemplated for use in the process of the present invention. Ortho phosphoric acid because of its general availability and effectiveness is preferred. As indicated above the phosphoric acid can be applied to the synthetic polymer by first impregnating the material with elemental phosphorus and thereafter oxidizing the elemental phosphorus on the fiber and hydrolyzing the oxidized phosphorus. This procedure probably results in the formation of a mixture of phosphoric acids, but for convenience, it is presumed that hydrolyzed product is essentially pyrophosphoric acid and such will be so-called hereinafter.

Although the flame proofing treatment of this invention initially results in fabrics having an Oxygen Index of at least 40, this value has been found to decrease as a result of repeated washing of the treated fabric. It has now been found, that the flame proof character of the phosphoric acid treated materials can be stabilized, that is flame proofing treatment can be rendered fast to washing, by applying to the treated material an epoxy resin and causing the latter to react with the phosphoric acid, in situ. It is known that epoxy resins react with acids forming acido-hydrins according to the general reaction.

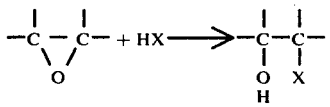

wherein X is the acid anion.

It is believed that in the present instance, that the epoxy resin reacts with the phosphoric acid on the fabric to produce in situ a substantially insoluble phospho-hydrin according to the general reactions.

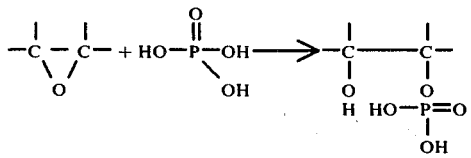

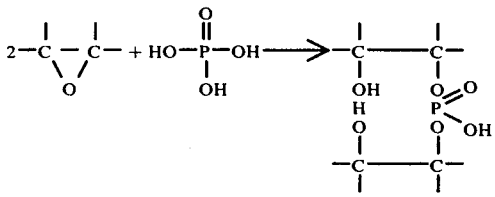

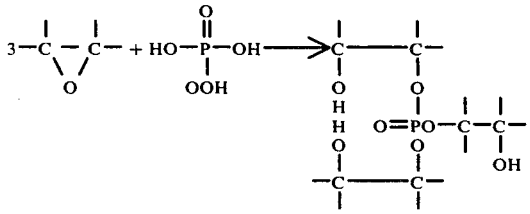

As indicated, one mol proportion of phosphoric acid may react with up to three mol equivalent proportions of the epoxy resin. It has been found that by controlling the temperature, time and concentration of reactants in and during this reaction, from nil reaction to substantially complete reaction can be effected.

It has thus been found that by dipping, immersing, spraying, roller coating, or otherwise applying to the phosphoric acid treated fabric an organic solvent solution of an epoxy resin, and thereafter heating the thus impregnated fabric to cause the epoxy resin to react, in situ, with the phosphoric acid, the treated fabric is thereby rendered fast to washing in cold water.

In accordance with a preferred mode of carrying out the process of the present invention a normally flammable synthetic material is treated in accordance with the process disclosed in Ser. No. 230,999, to effect an add on of about 0.5 to 15 percent by weight of phosphoric acid, preferably from about 2 to about 10 percent by weight phosphoric acid. The treated material is dried and then treated by immersion, spraying, or the like, with a solvent solution of an epoxy resin sufficient in amount to provide from about one to about three moles of epoxy resin per mole of phosphoric acid in the fabric. The epoxy solution contains from about one to about 50 percent by weight of the epoxy resin preferably from about 5 to about 20 percent by weight. Thereafter the fabric is dried to remove the solvent and heated to cause the epoxy resin to react, in situ, with the phosphoric acid. Generally a temperature of from about 75 to about 150 degrees centigrade and preferably from about 100 to about 120 degrees centigrade is required for this in situ reaction, although higher or lower temperatures may be required depending upon the reactivity of the specific epoxy resin used.

Any epoxy resin which will react with phosphoric acid to form a phospho-hydrin type compound, as disclosed above can be used in the process of the present invention. Suitable epoxy resins, many of which are commercially available articles of commerce, preferably are of the epoxidized fatty oils and esters such as soy bean oil, tall oil fatty acids, oleic acid and the like epoxidized polyols such as bisphenol A (4,4'-isopropylidenediphenol) aliphatic glycols and the like, and epoxidized novolac resins. The following typical epoxy resins are representative of the epoxy resins suitable for use in the present invention.

Epoxidized soybean oil, available commercially under the trade designation of Drapex 6.8, of Paraplex G-60, G-61, and G-62, and of Plastoflex ESO.

Epoxidized linseed oil, available commerically under the trade designation of Epoxol 9-5 (see U.S. Pat. No. 3,377,304).

Dicyclopentadiene Dioxide

Diglycidyl ether of bisphenol A available commercially under the trade designation of Epon 828, Diglycidyl ether of bisphenol-hexafluoroacetone, triglycidyl-p-aminophenol [4-(2,3-epoxy)propoxy-N,N-bis(2,3-epoxypropyl)aniline].

As is known, the commercially available epoxy resins are not pure chemicals but rather complex mixtures and are utilized with reference to their oxirane or epoxy value which is a measure of the number of epoxy moieties per 100 grams of epoxy product.

The epoxy resin is applied to the phosphoric acid treated fabric preferably as a solvent solution. Among the solvents which may be used the following are mentioned as typical examples acetone
methyl isobutyl ketone
1,1,1, trichloroethane
dimethylformamide
dimethylacetamide
ethylene dichloride Following application of the epoxy resin solution, the treated material may be freed of solvent by evaporation of the latter in a circulating air oven, by hanging the solvent wet cloth in air or by any other suitable means. The substantially solvent freed material is then "cured" by heating in a suitable oven at about 75° to about 150° centigrade, preferably at 100° to 120° centigrade for about 2 to about 20 minutes, to permit the reaction of the phosphoric acid and epoxy compound to proceed substantially to completion. Thereafter the "cured" material may be rinsed in cold water for about 2 to about 5 minutes to remove excess reagents and the treated cloth dried in any suitable fashion.

The following examples will illustrate the present invention. Parts and percentages are by weight and temperatures are given in degrees centigrade.

In these Examples 1–16, several strips, measuring 16 in. × 24 in. of a woven poly(m-phenyleneisophalamide) fabric weighing 170 grams per square yard in 300 parts of an aqueous solution containing 15 percent of 85 percent ortho-phosphoric acid and to which 12 drops of Triton X-100, (a commerically available non-ionic surfactant being essentially a mixture of acetyl phenoxy ethanols), were added. The wetted material was pressed on padder rolls under 30 pounds pressure and then dried in a heated current of air.

Strips measuring 4 in. × 12 in. of the treated material were immersed in solutions of four different epoxy resins, and of two different concentrations. The epoxy resins used were as follows:

A. Epoxidized soybean oil — available commercially as Paraplex G-61.
B. Epoxidized soybean oil available commercially as Drapex 6.8.
C. Diglycidyl ether of bisphenol A — available commercially as Epon 828.
D. Epoxidized linseed oil available commercially as Epoxol 9.5.

Thus a 5 percent and a 20 percent solution of each of the four epoxy resins in 1,1,1-trichloroethane was prepared and used to treat the phosphoric acid impregnated cloth strips. In addition 5 percent and 20 percent solutions of the four epoxy resins were prepared using acetone as the solvent and strips of the treated cloth immersed in these solutions also. The epoxy resin treated strips were heated to evaporate the solvents substantially completely and the dried strips were heated in an oven at 90° for five minutes.

Thereafter each of the cured strips were cut into six, 2 in. × 4 in. sections. One section of each group was then treated as follows after which the Oxygen Index was determined to ascertain the effect of the treatment on the flammable character of the treated material.

a. No water wash — control
b. 5 minute cold water wash
c. 15 minute cold water wash

TABLE I

| Example | Epoxy Compound | Solvent | Epoxy Conc. % | Oxygen Index No wash | Oxygen Index 5 min. Cold/ $H_2O$ | Oxygen Index 15 min. Cold/ $H_2O$ |
|---|---|---|---|---|---|---|
| 1 | "A" | Acetone | 20 | 60 | 58 | 40 |
| 2 | "B" | " | 20 | 54 | 54 | 48 |
| 3 | "C" | " | 20 | 58 | 40 | 45 |
| 4 | "D" | " | 20 | 56 | 52 | 42 |
| 5 | "A" | " | 5 | 48 | 36 | 32 |
| 6 | "B" | " | 5 | 48 | 38 | 32 |
| 7 | "C" | " | 5 | 60 | 28 | 35 |
| 8 | "D" | " | 5 | 60 | 38 | 34 |
| 9 | "A" | Trichloroethane | 20 | 60 | 54 | 55 |
| 10 | "B" | " | 20 | 62 | 58 | 54 |
| 11 | "C" | " | 20 | 60 | 58 | 55 |
| 12 | "D" | " | 20 | 62 | 50 | 55 |
| 13 | "A" | " | 5 | 62 | 30 | 30 |
| 14 | "B" | " | 5 | 62 | 34 | 48 |
| 15 | "C" | " | 5 | 62 | 30 | 35 |
| 16 | "D" | " | 5 | 62 | 32 | 32 |

Notes:
Oxygen Index of untreated fabric = 29 ± ½
Oxygen Index of $H_3PO_4$ treated fabric = 60 ± 2
[1]Treated samples heated at 90° for 5 minutes
[2]Treated samples reheated at 150° for 5 minutes These results indicate that in general treatment of the $H_3PO_4$ treated material with 5% solutions of the epoxy resin results in considerable leaching of the phosphoric acid and/or insufficient curing of the epoxy resin on the fiber ("in situ"). This latter explanation is particularly indicated by the results obtained with Epon 828, especially 5% acetone solution of Epon 828, (Example 7) where the 5 minute washing test resulted in complete removal of the phosphoric acid (O.I. of 28).

To confirm this, sections treated with 20% and 5% acetone solutions of Epon 828 and Epoxol 905 (See Examples 3, 4, 7 and 8) were reheated at 150° for 5 minutes and these sections were washed for 5 minutes in cold (23°) water. The Oxygen Index of these sections were as follows:

| | |
|---|---|
| 20% Epon 828 in Acetone | 52 |
| 5% Epon 828 in Acetone | 40 |
| 20% Epoxol 9.5 in Acetone | 50 |
| 5% Epoxol 9.5 in Acetone | 44 |

These results indicated that Epon 828 requires a higher curing temperature than other epoxy resins to form in situ the desired wash resistant reaction product with phosphoric acid. With respect to the Epoxol 9.5 treated materials, only in the instance of the 5% acetone solution was any improvement noted by the higher curing temperature. In this instance the more concentrated (20%) solution evidently produces sufficent cured product at 90° to give a desirable degree of wash fastness.

Inasmuch as the results in the above table appear to indicate that the epoxy resin treatment with 5% solutions of the epoxy resins followed by in situ reaction at 90° does not give satisfactory wash fastness, two sections, one treated with Paraflex G-61 and one treated with Epon 828 (5% in trichloroethane solvent) were reheated to 150° for 5 minutes, and then washed for 5 minutes in cold water. The Oxygen Index of the reheated sections were 54 (Paraplex G-61) and 46 (Epon 828) indicating that insufficient in-situ reaction has occurred at 90°.

As a result of the improvement in in situ reaction shown by the higher curing temperature with the above two sections, all of the remaining sections of epoxy treated material were reheated at 150° for 5 minutes and one of the reheated sections in each category of treatment was washed in cold water for 15 minutes. After drying, the Oxygen Index of each section was determined. The results obtained are set out in the last column of Table I above.

Again, these results indicate the importance of applying sufficient epoxy resin to the material prior to effecting the in situ reaction. The Oxygen Indexes of the sections treated with the 20 percent solutions show acceptable flame retardance after 15 minute washing in cold water, (Examples 1–4 and 9–12) whereas the sections treated with the more dilute, 5 percent solutions, except in one instance, that of Drapex 6.8 in 5 percent trichloroethane, Example 14, show little or no retention of the flame retardance characteristic after the 15 minute cold washing. (See Examples 5–8, 13, 15 and 16).

EXAMPLE 17

Woven poly(m-phenylene isophathamide) fabric was immersed in a 7.5 percent aqueous solution of 85 percent ortho phosphoric acid. The impregnated material was freed of excess liquor and then dried in a 110 degree oven for five minutes. The resulting material was immersed in a 10 percent solution of epoxidized soybean oil (Paraplex G-61) in 1,1,1-trichloroethane to thoroughly wet the phosphoric acid treated material. The thus treated material was then dried at 110° for 5 minutes. The Oxygen Index of the dried treated material was 58.

Three equal sized sections of the treated material, taken from the top, center and bottom portions of the treated material were washed in cold water for 15 minutes and then dried. The Oxygen Indexes of the washed sections varied from 46 to 54 to 50.

The invention has been described in the above specification and illustrated by reference to specific embodiments in the illustrative examples. However, it is to be understood that it is not to be so limited since changes and alterations in the specific details disclosed hereinabove may be made without departing from the scope or spirit of the invention disclosed herein.

I claim:

1. A flameproofed synthetic fibrous flexible textile material which is fast to washing in water and is characterized by an Oxygen Index of at least about 40, consisting essentially of a normally flammable, fibrous, synthetic material, which material is selected from the group consisting of polypropylene, poly(hexamethyleneadipamide), polycaproamide and poly(m-phenyleneisophthalamide), and a flame-retardant amount of the cured reaction product of a phosphoric acid and an epoxy resin capable of reacting with phosphoric acid to form a phospho-hydrin type compound, the amount of the epoxy resin being about one to about three moles per mole of phosphoric acid the phosphoric acid having been intimately admixed with said fibrous synthetic material prior to contact with the epoxy resin and the epoxy resin having been exclusively reacted in situ with the phosphoric acid after the phosphoric acid was admixed with the fibrous synthetic material.

2. The flameproofed synthetic fibrous flexible textile material of claim 1 wherein the epoxy resin is selected from the group consisting of epoxidized fatty oils and esters, epoxidized polyols and epoxidized novolac resins.

3. The material of claim 2 wherein the epoxy resin is an epoxidized fatty oil or ester.

4. The material of claim 2 wherein the epoxy resin is an epoxidized polyol.

5. The material of claim 2 wherein the epoxy resin is an epoxidized novolac resin.

6. The material of claim 1 wherein the material comprises at least 0.4 percent by weight of a phosphoric acid.

7. The material of claim 6 wherein the material comprises from about 2.0 to about 25 percent by weight of a phosphoric acid.

8. Flameproofed synthetic material as claimed in claim 1 wherein the phosphoric acid is ortho phosphoric acid.

9. The material of claim 3 wherein the epoxy resin is epoxidized soybean oil.

10. The material of claim 3 wherein the epoxy resin is epoxidized linseed oil.

11. The material of claim 4 wherein the epoxy resin is the diglycidyl ether of bisphenol A.

12. Flameproofed synthetic fibrous material as claimed in claim 1 wherein the normally flammable material is poly(phenyleneisophthalamide).

13. Flameproofed synthetic fibrous material as claimed in claim 3 wherein the normally flammable material is poly(phenyleneisophthalamide).

* * * * *